US009112255B1

(12) United States Patent
Hollenbeck et al.

(10) Patent No.: US 9,112,255 B1
(45) Date of Patent: Aug. 18, 2015

(54) RADIO FREQUENCY COMPARATOR WAVEGUIDE SYSTEM

(75) Inventors: Michael C. Hollenbeck, Salt Lake City, UT (US); Douglas H. Ulmer, Salt Lake City, UT (US); Troy M. Rueckert, Salt Lake City, UT (US); Neil K. Harker, Salt Lake City, UT (US)

(73) Assignee: L-3 Communications Corp., New York, NY (US)

( * ) Notice: Subject to any disclaimer, the term of this patent is extended or adjusted under 35 U.S.C. 154(b) by 555 days.

(21) Appl. No.: 13/419,108

(22) Filed: Mar. 13, 2012

(51) Int. Cl.

| | |
|---|---|
| ***H01P 3/12*** | (2006.01) |
| ***H01P 5/20*** | (2006.01) |
| *H01P 1/208* | (2006.01) |
| *H01P 5/18* | (2006.01) |

(52) U.S. Cl.
CPC .. *H01P 5/20* (2013.01); *H01P 5/182* (2013.01)

(58) Field of Classification Search
CPC ..... H01P 5/024; H01P 5/20
USPC ..... 333/110, 111, 112, 113, 117, 121, 122
See application file for complete search history.

(56) References Cited

U.S. PATENT DOCUMENTS

| | | | | | |
|---|---|---|---|---|---|
| 3,491,821 | A | * | 1/1970 | Graumann et al. | 159/13.4 |
| 3,719,949 | A | * | 3/1973 | Hemmi | 342/424 |
| 3,877,031 | A | * | 4/1975 | Mailloux et al. | 343/778 |
| 3,982,244 | A | | 9/1976 | Ward et al. | |
| 4,042,931 | A | | 8/1977 | Gustafsson | |
| 4,420,756 | A | * | 12/1983 | Hamada et al. | 342/153 |
| 4,616,230 | A | | 10/1986 | Antonucci et al. | |
| 4,639,731 | A | | 1/1987 | Karlsson et al. | |
| 4,720,691 | A | * | 1/1988 | Rammos | 333/122 |
| 4,721,959 | A | | 1/1988 | Syrigos | |
| 4,812,788 | A | * | 3/1989 | Wong et al. | 333/113 |
| 4,989,011 | A | * | 1/1991 | Rosen et al. | 342/373 |
| 5,017,927 | A | | 5/1991 | Agrawal et al. | |
| 5,274,839 | A | * | 12/1993 | Kularajah et al. | 333/113 |
| 5,276,452 | A | | 1/1994 | Schuss et al. | |
| 5,329,285 | A | * | 7/1994 | McCandless | 342/153 |
| 5,614,874 | A | | 3/1997 | McCandless | |
| 6,169,518 | B1 | | 1/2001 | Nelson et al. | |
| 6,243,052 | B1 | | 6/2001 | Goldstein et al. | |
| 6,577,207 | B2 | * | 6/2003 | Volman | 333/125 |
| 6,847,270 | B2 | * | 1/2005 | Yoneda et al. | 333/135 |
| 6,882,244 | B2 | * | 4/2005 | Stenberg | 333/117 |

(Continued)

OTHER PUBLICATIONS

Clarricoats et al., "Multimode corrugated waveguide feed for monopulse radar," IEE Proc. vol. 128, Pt. H, No. 2 (Apr. 1981) pp. 102-110.

(Continued)

*Primary Examiner* — Dean Takaoka
(74) *Attorney, Agent, or Firm* — Kirton | McConkie

(57) ABSTRACT

A phase shifting component of a waveguide comparator subsystem can effect a relative phase shift that advances an input signal A relative to an input signal B. A comparator component can then split those signals such that a first part of signal A and a second part of signal B are combined at a difference port, and a first part of signal B and a second part of signal A are combined at a sum port. The comparator can delay the phase of the second parts of the signals such that, with the relative phase shift of the phase shifting component, the first part of signal A and the second part of signal B are one-hundred eighty degrees (180°) out of phase at the difference port, and the second part of signal A and the first part of signal B are in phase at the sum port.

18 Claims, 10 Drawing Sheets

(56) References Cited

U.S. PATENT DOCUMENTS 7,432,780 B2 * 10/2008 Chan et al. ..... 333/127
8,493,161 B2 * 7/2013 Bosshard et al. ..... 333/21 A

OTHER PUBLICATIONS

Elliot et al., "Corrugated Waveguide Monopulse Feed," Electronics Letters, vol. 16, No. 9 (Apr. 24, 1980), pp. 324.
Evans et al., "Feed for a Four-Horn Monopulse Tracking Radar," Aerospace Applications Conference, IEEE (1991) (10 pages).
Goudey et al., "High Power X-B and Monopulse Tracking Feed for the Lincoln Laboratory Long-Range Imaging Radar," IEEE Transactions on Microwave Teory and Techniques, vol. MTT-26, No. 5 (May 1978), pp. 326-332.
Haidan et al., "Design of fast-scanning millimeter-wave monopulse antenna," Southwest China Institute of Electronic Technology, IEEE (2006) (4 pages).
Kinsey, "An edge-Slotted Waveguide Array with Dual-Plane Monopulse," IEEE Transactions on Antennas and Propagation, vol. 47, No. 3 (Mar. 1999), pp. 474-481.
Lee et al., "Design of E-Plane Monopulse Feeder Using Multimode Corrugated Rectangular Waveguide," Dept. of Electronics Engr., Seoul National University, IEEE (1994), pp. 982-985.
Meng et al., "Compact Monopulse Antenna with Low Sidelobe at Ka-band," State Key Laboratory of Millimeter Waves, Southeast University, China (2008) pp. 419-422.
Meyer et al., "On the design of waveguide devices using multiple propagating modes," Telsiks 2003, Servia and Montenegro, Nis, IEEE (8 pages).
Varghese et al., "Computer Aided Design of Planar Waveguide Monopulse Comparator for Low Height Airborne Antennas," Radar 97, Publication No. 449 (IEE Oct. 1997), pp. 522-525.
You et al., "Design and Optimization of Planar Waveguide Magic Tee At W-Band," Microwave and Millimeter Wave Technology, IEEE (2007) (4 pages).

* cited by examiner

RADIO FREQUENCY COMPARATOR WAVEGUIDE SYSTEM

BACKGROUND

Various configurations of waveguide systems have been used to combine multiple radio frequency (RF) signals into sum and difference combinations. One common application for such a waveguide configuration is a mono-pulse antenna system. In a mono-pulse antenna system, an RF signal is received at an antenna with two or more regions disposed about a bore sight. One or more angles from the bore sight of the incoming RF signal—and thus the target from which the mono-pulse RF signal came—can be determined from sum and difference combinations of RF signals from the two or more antenna regions. Aspects of the present invention include an improved waveguide comparator subsystem that can combine RF signals to produce sum and difference combinations. Embodiments of the invention can have particular application in mono-pulse antenna systems, which can be part of a mono-pulse tracking system or a mono-pulse data link system, and in other applications in which sum and difference combinations of two or more RF signals (e.g., mono-pulse radar systems) are determined.

SUMMARY

In some embodiments of the invention, a waveguide apparatus can comprise an RF phase shift component and an RF comparator component. The RF phase shift component can include an input port A and an input port B, and the RF phase shift component can be structured to advance by X degrees a phase of an RF signal A at the input port A relative to a phase of an RF signal B at the input port B. The RF comparator component can be connected to the phase shift component and can include a difference port and a sum port. The comparator component can be structured to split the RF signal A output from the phase shift component into a first part of signal A and a second part of signal A in which a phase of the second part of signal A is delayed by Y degrees. The comparator component can be structured to further split the RF signal B output from the phase shift component into a first part of signal B and a second part of signal B in which a phase of the second part of signal B is delayed by Y degrees. The structure of the comparator component can further combine at the difference port the first part of signal A and the second part of signal B, and combine at the sum port the first part of signal B and the second part of signal A. The values of X and Y can be such that X plus Y is approximately 180 degrees.

In some embodiments of the invention, a process of combining RF signals into sum and difference combinations can include advancing in a phase shift component a phase of an RF signal A relative to an RF signal B by X degrees. The process can also include splitting in a comparator component the RF signal A into a first part of signal A and a second part of signal A in which a phase of the second part of signal A is delayed by Y degrees relative to the first part of signal A, and the process can further include splitting in the comparator component the RF signal B into a first part of signal B and a second part of signal B in which a phase of the second part of signal B is delayed by Y degrees relative to the first part of signal B. The process can also include combining at a difference port of the comparator component the first part of signal A and the second part of signal B and combining at a sum port of the comparator component the first part of signal B and the second part of signal A. The values of X and Y can be such that X plus Y is approximately 180 degrees.

In some embodiments, a waveguide apparatus can include a plurality of comparator waveguide subsystems. A first of the comparator waveguide subsystems can include an input port A, an input port B, a difference port A−B, and a sum port A+B. The first comparator waveguide subsystem can be structured to produce at difference port A−B a difference signal A−B that is a subtraction of a signal A at input port A from a signal B at input port B and also produce at sum port A+B a sum signal A+B that is a sum of the signal A and the signal B. A second of the comparator waveguide subsystems can include an input port C, an input port D, a difference port C−D, and a sum port C+D, and the second comparator waveguide subsystem can be structured to produce at the difference port C−D a difference signal C−D that is a subtraction of a signal C at input port C from a signal D at input port D and also produce at the sum port C+D a sum signal C+D that is a sum of the signal C and the signal D. A third of the comparator waveguide subsystems can include an input port A−B connected to the difference port A−B of the first comparator, an input port C−D connected to the difference port C−D of the second comparator, a difference port (A−B)−(C−D), and a sum port (A−B)+(C−D). The third comparator waveguide subsystem can be structured to produce at the difference port (A−B)−(C−D) a difference signal (A−B)−(C−D) that is a subtraction of the difference signal C−D from the difference signal A−B and also produce at the sum port (A−B)+(C−D) a sum signal (A−B)+(C−D) that is a sum of the difference signal A−B and the difference signal C−D. A fourth of the comparator waveguide subsystems can include an input port A+B connected to the sum port A+B of the first comparator, an input port C+D connected to the sum port C+D of the second comparator, a sum port (A+B)+(C+D), and a difference port (A+B)−(C+D). The fourth comparator waveguide subsystem can be structured to produce at the difference port (A+B)−(C+D) a difference signal (A+B)−(C+D) that is a subtraction of the sum signal C+D and the sum signal A+B and also produce at the sum port (A+B)+(C+D) a sum signal (A+B)+(C+D) that is a sum of the sum signal A+B and the sum signal C+D.

In some embodiments, a process of combining radio frequency signals into sum and difference combinations can include generating in first and second parallel comparator waveguide subsystems from four parallel input RF signals A, B, C, and D an RF difference signal A−B, an RF difference signal C−D, an RF sum signal A+B, and an RF sum signal C+D. The difference signal A−B can be a subtraction of the signal B from the signal A, and the difference signal C−D can be a subtraction of the signal D from the signal C. The sum signal A+B can be an addition of the signal A and the signal B, and the sum signal C+D can be an addition of the signal C and the signal D. The process can also include generating in third and fourth parallel comparator waveguide subsystems from the difference signal A−B, the difference signal C−D, the sum signal A+B, and the sum signal C+D an RF difference signal (A−B)−(C−D), an RF difference signal (A+B)−(C+D), an RF sum signal (A−B)+(C−D), and an RF sum signal (A+B)+(C+D). The difference signal (A−B)−(C−D) can be a subtraction of the signal C−D from the signal A−B, and the difference signal (A+B)−(C+D) can be a subtraction of the signal C+D from the signal A+B. The sum signal (A−B)+(C−D) can be an addition of the signal A−B and the signal C−D, and the sum signal (A+B)+(C+D) can be an addition of the signal A+B and the signal C+D.

DETAILED DESCRIPTION OF EXEMPLARY EMBODIMENTS

Figure 1:
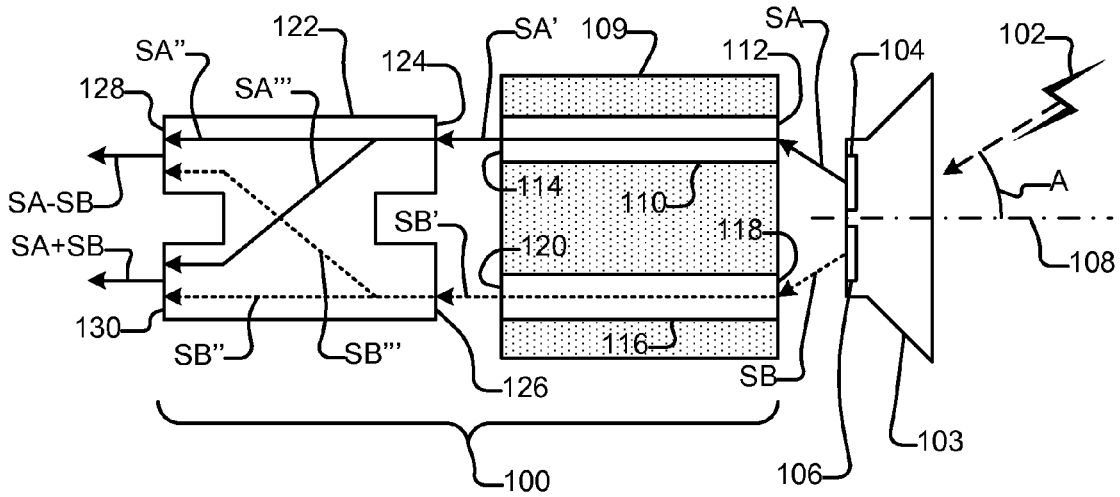
FIG. 1 is a simplified block diagram of a system that includes a radio frequency comparator waveguide subsystem according to some embodiments of the invention.

This specification describes exemplary embodiments and applications of the invention. The invention, however, is not limited to these exemplary embodiments and applications or to the manner in which the exemplary embodiments and applications operate or are described herein. Moreover, the Figures may show simplified or partial views, and the dimensions of elements in the Figures may be exaggerated or otherwise not in proportion for clarity. In addition, as the terms "on," "attached to," or "coupled to" are used herein, one object (e.g., a material, a layer, a substrate, etc.) can be "on," "attached to," or "coupled to" another object regardless of whether the one object is directly on, attached, or coupled to the other object or there are one or more intervening objects between the one object and the other object. Also, directions (e.g., above, below, top, bottom, side, up, down, under, over, upper, lower, horizontal, vertical, "x," "y," "z," etc.), if provided, are relative and provided solely by way of example and for ease of illustration and discussion and not by way of limitation. In addition, where reference is made to a list of elements (e.g., elements a, b, c), such reference is intended to include any one of the listed elements by itself, any combination of less than all of the listed elements, and/or a combination of all of the listed elements.

As used herein, a "waveguide system" or "waveguide subsystem" is a plurality of interconnected RF waveguide elements. A "waveguide component" is an RF waveguide element that alters a response (e.g., a characteristic) of a propagating signal. The "fundamental waveguide mode" of an RF signal propagating in a waveguide system or subsystem is the exciting mode of the signal, which is the mode in which the signal was excited in the waveguide system or subsystem. The fundamental waveguide mode of a signal thus does not include modes generated by discontinuities in the waveguide system or subsystem while the signal is propagating through the waveguide system or subsystem. A "bore sight" is a central axis about which two or more antennas or regions of an antenna are disposed.

Some embodiments of the invention can comprise an RF phase shifting component connected to an RF comparator component. The phase shifting component can effect a relative phase shift that advances an RF input signal A relative to an RF input signal B. The comparator component can split each of those signals such that a first part of signal A and a second part of signal B are combined at a difference port, and a first part of signal B and a second part of signal A are combined at a sum port. The comparator can delay the phase of the second parts of the signals such that, with the relative phase shift of the phase shifting component, the first part of signal A and the second part of signal B are substantially one-hundred eighty degrees (180°) out of phase at the difference port, and the second part of signal A and the first part of signal B are substantially in phase at the sum port.

Figure 2:
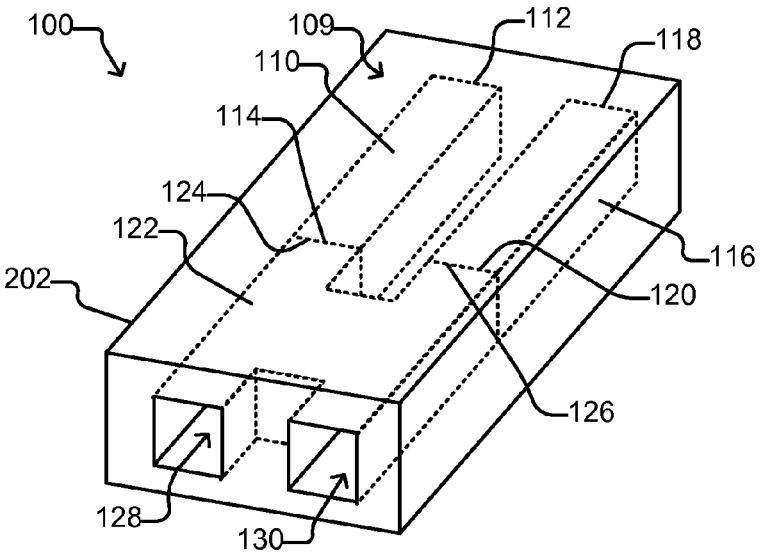
FIG. 2 illustrates an example of the comparator waveguide subsystem of FIG. 1 according to some embodiments of the invention.

FIG. 1 illustrates a simplified block diagram of an RF comparator waveguide subsystem 100 according to some embodiments of the invention. As shown, the comparator waveguide subsystem 100 can comprise an RF phase shift component 109 and an RF comparator component 122. As illustrated in FIG. 2, the comparator waveguide subsystem 100 can be implemented in a waveguide structure 202 that is linear (straight). That is, the phase shift component 109 and the comparator component 122 can be implemented in a straight section or sections of an RF waveguide structure 202.

As shown in FIG. 1, the phase shift component 109 can comprise a first RF phase shift arm 110 and a second RF phase shift arm 116, which can be disposed in parallel as shown. The phase shift arm 110 can comprise an input port 112 and an output port 114, and the phase shift arm 116 can similarly comprise an input port 118 and an output port 120. Each phase shift arm 110 and 116 can be configured to advance and/or delay the phase of an RF signal appearing at its input port. Thus, the phase of an RF signal SA' at the output port 114 of the phase shift arm 110 can be advanced or delayed with respect to the RF signal SA at the input port 112. Similarly, the phase of an RF signal SB' at the output port 120 of the phase shift arm 116 can be advanced or delayed with respect to the RF signal SB at the input port 118.

The phase shift arms 110 and 116 can be configured to impart different phase changes so that the phase shift component 109 effects a relative change in the phase of signal SA with respect to signal SB. For example, the phase shift arms 110 and 116 can be configured to advance the phase of the signal SA relative to the signal SB so that the phase of signal SA' is advanced relative to the signal SB'. As just one example, the phase shift arm 110 can advance the phase of signal SA' by approximately forty-five degrees (45°) while the phase shift arm 116 delays the phase of signal SB' by approximately forty-five degrees (45°). In such an example, the phase shift component 109 effects a relative phase shift of substantially ninety degrees (90°) between signal SA and signal SB such that the phase of signal SA' is substantially ninety degrees (90°) advanced relative to signal SB'.

As shown in FIG. 1, the output ports 114 and 120 of the phase shift component 109 can be connected to input ports 124 and 126 of the comparator component 122. The output ports 114 and 120 can be connected directly to the input ports 124 and 126. Alternatively, connectors (not shown) can connect the output ports 114 and 120 to the input ports 124 and 126 of the comparator component 122. For example, output ports 114 and 120 can be different sizes, shapes, or the like or can be spaced apart a different distance than the input ports 124 and 126, and connectors (not shown) can accommodate such differences in size, shape, or spacing.

The comparator component 122 can be configured to split the signal SA' at input port 124 into a first signal part SA" and a second signal part SA'". For example, the comparator component 122 can be symmetrical and thus split the signal SA' such that substantially half the power is in the first signal part SA" and half the power is in the second signal part SA".

The comparator component 122 can also be configured to delay the phase of the second signal part SA'" relative to the first signal part SA". As shown in FIG. 1, the first part of the signal SA" can pass directly to a difference port 128, and the second part of the signal SA'" can pass to a sum port 130. As shown in FIG. 1, the comparator component 122 can be configured such that the path of the second signal part SA'" to the sum port 130 is longer than the path of the first signal part SA" to the difference port 128. This can delay by Y degrees the phase of the second signal part SA'" relative to the first signal part SA". As will be seen, comparator component 122 can be configured such that the amount of the phase delay Y degrees plus the relative phase delay X degrees produced by the phase shift component 109, as discussed above, is approximately one-hundred eighty degrees (180°).

The comparator component 122 can be configured to operate similarly on the signal SB' at the input port 126. That is, the comparator component 122 can be configured to split the signal SB' at the input port 126 into a first signal part SB" and a second signal part SB'". For example, the comparator component 122 can be symmetrical and thus split the signal SB' such that substantially half the power is in the first signal part SB" and half the power is in the second signal part SB'".

The comparator component 122 can also be configured to delay the phase of the second signal part SB'" relative to the first signal part SB". As shown in FIG. 1, the first part of the signal SB" can pass directly to the sum port 130, and the second part of the signal SB'" can pass to the difference port 128. Generally as discussed above, the comparator component 122 can be configured such that the path of the second signal part SB'" to the difference port 128 is longer than the path of the first signal part SB" to the sum port 130, which can delay by the amount Y degrees (discussed above) the phase of the second signal part SB'" relative to the first signal part SB".

The first signal part SA" and the second signal part SB'" can combine at the difference port 128. As noted above, the amount X degrees by which the phase shift component 109 advances the phase of the signal SA' and the amount Y degrees by which the comparator component 122 delays the second signal parts SA'" and SB'" can be approximately one-hundred eighty degrees (180°). That being the case, the amount X degrees by which the phase shift component 109 advances the phase of the signal SA' relative to the signal SB' and the amount Y degrees by which the comparator component 122 delays the phases of the second signal parts SA'" and SB'" can put the first signal part SA" and the second signal part SB'" substantially one-hundred eighty (180°) out of phase at the difference port 128. The resulting combined signal SA−SB at the difference port 128 can thus be proportional to a subtraction of the signal SB from the signal SA. Similarly, the first signal part SB" and the second signal part SA'" can combine at the sum port 130. However, the amount X degrees by which the phase shift component 109 advances the phase of the signal SA' relative to the signal SB' and the amount Y degrees by which the comparator component 122 delays the phases of the second signal parts SA'" and SB'" can put the first signal part SA" and the second signal part SB'" substantially in phase at the sum port 130. The resulting combined signal SA+SB at the sum port 130 can thus be proportional to an addition of the signal SA and the signal SB.

In some embodiments, the value X degrees can be positive ninety degrees (+90°) and the value of Y degrees can be negative ninety degrees (−90°). In such an embodiment, phase shift component 109 can advance the phase of the signal SA' positive ninety degrees (+90°) with respect to the signal SB'. The relative phase change of the signal SA' can thus be positive ninety degrees (+90°), and the relative phase of the signal SB' can be zero. This can be accomplished, for example, by configuring the phase shift arm 110 to advance the phase of the signal SA' by substantially forty-five degrees (+45°) and the phase shift arm 116 to delay the phase of the signal SB' by substantially forty-five degrees (−45°). The comparator component 122 can then change the phase of the second signal parts SA'" and SB'" by negative ninety degrees (−90°) relative to the first signal parts SA" and SB". At the difference port 128, the relative phase change of the first signal part SA" is thus positive ninety degrees (+90°) and the relative phase change of the second signal part SB'" is thus negative ninety degrees (−90°). The resulting combined signal SA−SB at the difference port 128 is thus the signal SA minus the signal SB. At the sum port 130, the relative phase changes of the first signal part SB" and the second signal part SA'" are both zero, and the resulting combined signal SA+SB at the sum port 130 is thus the signal SA plus the signal SB.

The comparator waveguide subsystem 100 can thus produce at the difference port 128 a combined signal SA−SB that is the difference of the signals SA and SB at the input ports 112 and 118, and the comparator waveguide subsystem 100 can produce at the sum port 130 a combined signal SA+SB that is the sum of the signals SA and SB at the input ports 112 and 118. In addition, the comparator waveguide subsystem 100 can do so in a straight section or sections of a waveguide structure 202 as illustrated in FIG. 2 and discussed above. Also, the phase shift arms 110 and 116 can be substantially the same length. That is, the length of the phase shift arm 110 from the input port 112 to the output port 114 can be substantially the same as the length of the phase shift arm 116 from the input port 118 to the output port 120. This can have any number of advantages including ease of manufacture and simplifying connecting the phase shift component 109 and/or the comparator waveguide subsystem 100 to other components (not shown) of an antenna system. Similarly, the length of the comparator component 122 from the input port 124 to the difference port 128 can be substantially the same as the length of the comparator component 122 from the input port 126 to the sum port 130.

Moreover, when the RF signal SA is in only the fundamental waveguide mode at the input port 112 and the RF signal SB is in only the fundamental waveguide mode at the input port 118, the combined RF signal SA−SB can be only in the fundamental waveguide mode at difference port 128, and the combined RF signal SA+SB can be only in the fundamental waveguide mode at the sum port 130. This can advantageously allow the combined RF signal SA−SB to be simultaneously sampled at the difference port 128 with the combined RF signal SA+SB at the sum port 130. Filtering (e.g., polarized filtering such as septum filtering) or other mechanisms (not shown) can be provided prior to the input ports 112 and 118 to put RF signals SA and SB into only their fundamental waveguide mode at input ports 112 and 118.

In fact, the phase shift component 109 can be configured so that the RF signal SA and the RF signal SB in only the fundamental waveguide mode at the input ports 112 and 118 produce the RF signal SA' and the RF signal SB' in only the fundamental waveguide mode at output ports 114 and 120.

The comparator component 122 can likewise be configured such that that the RF signal SA' and the RF signal SB' in only the fundamental waveguide mode at the input ports 124 and 126 produce the combined RF signals SA−SB and SA+SB in only the fundamental waveguide mode at the difference and sum ports 128 and 130 as discussed above. Examples of configurations of the phase shift component 109 and the comparator component 122 for accomplishing this are illustrated in FIGS. 6A-9 and discussed below.

There are a number of possible applications for the comparator waveguide subsystem 100 illustrated in FIG. 1. One such example is to track a moving target (not shown) from which the RF signal 102 is directed. For example, the RF signal 102 can be transmitted from an antenna (not shown) on a moving target (not shown) that the antenna system of FIG. 1 is to track. The antenna system of FIG. 1 and an antenna (not shown) on a moving target (not shown) can be part of, for example, a mono-pulse tracking system (e.g., a mono-pulse data link system). The antenna system of FIG. 1 can thus be a mono-pulse tracking antenna. Another example of an application of the comparator waveguide subsystem 100 of FIG. 1 is in a mono-pulse radar system in which the RF signal 102 can be a radar pulse bounced off of a moving target (not shown) to be tracked.

FIG. 1 includes a simplified block diagram of an antenna 103 with antenna regions 104 and 106 disposed about a bore sight axis 108 such as can be part of a single-axis mono-pulse antenna system. The antenna 103 and antenna regions 104 and 106 can be any kind of antenna suitable for use in a mono-pulse antenna system. For example, the antenna 103 can be a horn antenna (e.g., disposed at the focal point of a parabolic reflector antenna (not shown)), and the antenna regions 104 and 106 can be feed holes to the horn antenna. Alternatively, the antenna regions 104 and 106 can each be a distinct horn antenna. As yet further alternatives, the antenna regions 104 and 106 can be other types of antennas.

An incoming RF signal 102 striking the antenna 103 can cause the antenna region 104 to generate the signal SA and the antenna region 106 to generate the signal SB. As noted above, the RF signal 102 can be from any of several sources. For example, the RF signal 102 can be transmitted from a moving target (not shown) that is to be tracked. As another example, the RF signal 102 can be a radar mono-pulse reflected off of a moving target (not shown) that is to be tracked.

As discussed above, the comparator waveguide subsystem 100 can produce at the difference port 128 a combined signal SA−SB that is the mathematical subtraction of the signal SB from the signal SA, and the comparator waveguide subsystem 100 can produce at the sum port 130 a combined signal SA+SB that is the mathematical addition of the signal SA and the signal SB. The amplitudes and relative phases of the combined signal SA−SB and the combined signal SA+SB can be used to determine an angle A (see FIG. 1) of the incoming RF signal 102 from the bore sight axis 108. For example, the difference between the amplitudes of the combined signal SA−SB and the combined signal SA+SB and the relative phases of those combined signals can be used to determine the angle A in FIG. 1. In some embodiments, the antenna 103 (including antenna regions 104 and 106) can be oriented such that the angle A corresponds to the azimuth angle of the target (not shown) from which the RF signal 102 came. The antenna 103 can alternatively be oriented such that the angle A corresponds to the elevation angle of the target (not shown).

As noted, FIG. 1 is a block diagram and thus shows a simplified illustration. Other elements can be used with the system shown in FIG. 1. For example, there can be waveguide elements (not shown) between the antenna regions 104 and 106 and the input ports 112 and 118. Examples of such waveguide elements include filters or polarizers (e.g., septum polarizers) disposed between the antenna regions 104 and 106 and the input ports 112 and 118. Thus, for example, the signals SA and SB at input ports 112 and 118 can be filtered and/or polarized (e.g., circularly polarized) versions of the signals generated by the antenna regions 104 and 106 in response to the RF signal 102. As noted above, the signals SA and SB can be filtered and/or polarized such that signals SA and SB are in only the fundamental waveguide mode at input ports 112 and 118. As another example, further elements, components, or equipment (not shown) can be included for guiding, modifying, processing, utilizing, and/or storing the combined signals SA−SB and SA+SB produced at the difference and sum ports 128 and 130.

Figure 3A:
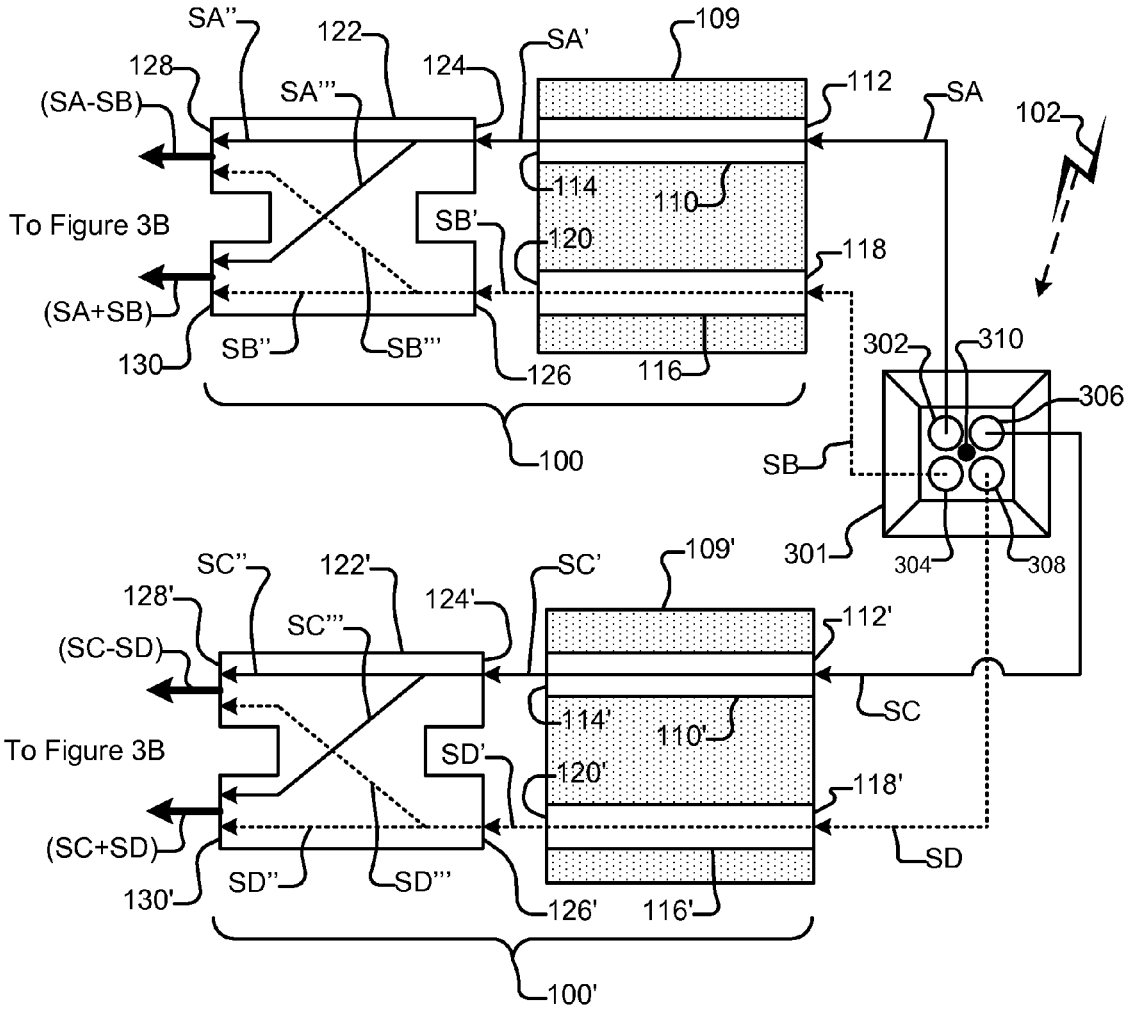
FIGS. 3A and 3B illustrate a simplified block diagram of a system that includes a plurality of interconnected comparator waveguide subsystems according to some embodiments of the invention.
Figure 3B:
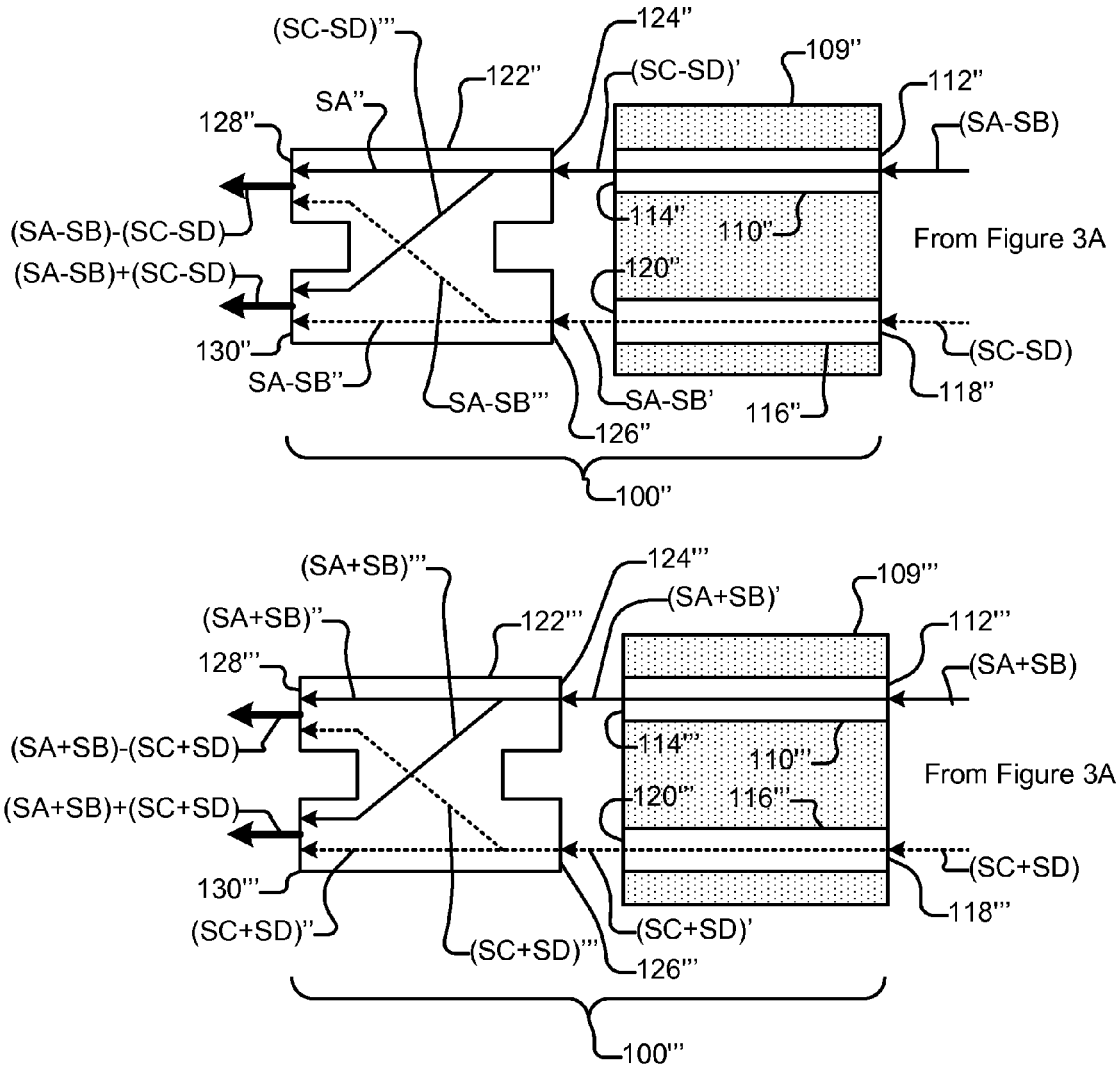

FIG. 1 illustrates use of one RF comparator waveguide subsystem 100 to add and subtract two RF signals SA and SB. In other embodiments, multiple instances of the comparator waveguide subsystem 100 can be used to add and subtract more than two RF signals. FIGS. 3A and 3B illustrate an example in which four instances 100, 100', 100", and 100'" of the RF comparator waveguide subsystem 100 can add and subtract combinations of four RF signals SA, SB, SC, and SD.

In the example illustrated in FIGS. 3A and 3B, each instance of the comparator waveguide subsystem 100 can be generally the same as illustrated in and discussed above with respect to FIG. 1. That is, each comparator waveguide subsystem 100 (and 100', 100", and 100'") in FIGS. 3A and 3B can produce at its difference port 128 (and 128', 128", and 128'") and sum port 130 (and 130', 130", and 130'") combined signals that are, respectively, a subtraction of and an addition of the signals at the input ports 112 (and 112', 112", and 112'") and 118 (and 118', 118", and 118'"). As will be seen, the comparator waveguide subsystems 100, 100', 100", and 100'" can be connected in parallel and series to produce the following from input RF signals SA, SB, SC, and SD: (SA−SB)−(SC−SD); (SA−SB)+(SC−SD); (SA+SB)−(SC+SD); and (SA+SB)+(SC+SD).

As shown in FIG. 3A, RF signals SA and SB can be provided to the input ports 112 and 118 of a first comparator waveguide subsystem 100 to produce at the difference port 128 a combined RF signal SA−SB that is a subtraction of the signal SB from the signal SA and at the sum port 130 an RF signal SA+SB that is an addition of the signal SA and signal SB. RF signals SC and SD can similarly be provided to the input ports 112' and 118' of a second comparator waveguide subsystem 100' to produce at the difference port 128' a combined RF signal SC−SD that is a subtraction of the signal SD from the signal SC and at the sum port 130' a combined RF signal SC+SD that is an addition of the signal SC and signal SD. The RF signals SA, SB, SC, and SD can be provided generally in parallel to the first and second comparator waveguide subsystem 100 and 100', which can be disposed and operate generally in parallel.

Referring to FIG. 3B, the outputs comprising combined signals SA−SB, SA+SB, SC−SD, and SC+SD of the first and second comparator waveguide subsystems 100 and 100' can be provided to the input ports 112", 118", 112'", and 118'" of third and fourth comparator waveguide subsystems 100" and 100'". As shown, the difference port 128 (and thus the combined signal SA−SB) of the first comparator waveguide subsystem 100 can be connected to the input port 112" of the third comparator waveguide subsystem 100", and the difference port 128' (and thus the combined signal SC−SD) of the second comparator waveguide subsystem 100' can be connected to the input port 118" of the third comparator waveguide subsystem 100". The third comparator waveguide subsystem 100" can then produce at its difference port 128" a combined signal (SA−SB)−(SC−SD) that is a subtraction of the signal SC−SD from the signal SA−SB. The third comparator waveguide subsystem 100" can similarly produce at its sum port 130" a combined signal (SA−SB)+(SC−SD) that is an addition of the signal SA−SB and the signal SC−SD.

As also shown in FIG. 3B, the sum port 130 (and thus the combined signal SA+SB) of the first comparator waveguide subsystem 100 can be connected to the input port 112'" of a fourth comparator waveguide subsystem 100'", and the sum port 130' (and thus the combined signal SC+SD) of the second comparator waveguide subsystem 100' can be connected to the input port 118'" of the fourth comparator waveguide subsystem 100'". The fourth comparator waveguide subsystem 100'" can then produce at its difference port 128'" a combined signal (SA+SB)−(SC+SD) that is a subtraction of the signal SA+SB from the signal SC+SD. The fourth comparator waveguide subsystem 100'" can similarly produce at its sum port 130'" a combined signal (SA+SB)+(SC+SD) that is an addition of the signal SA+SB and the signal SC+SD.

Figure 4A:
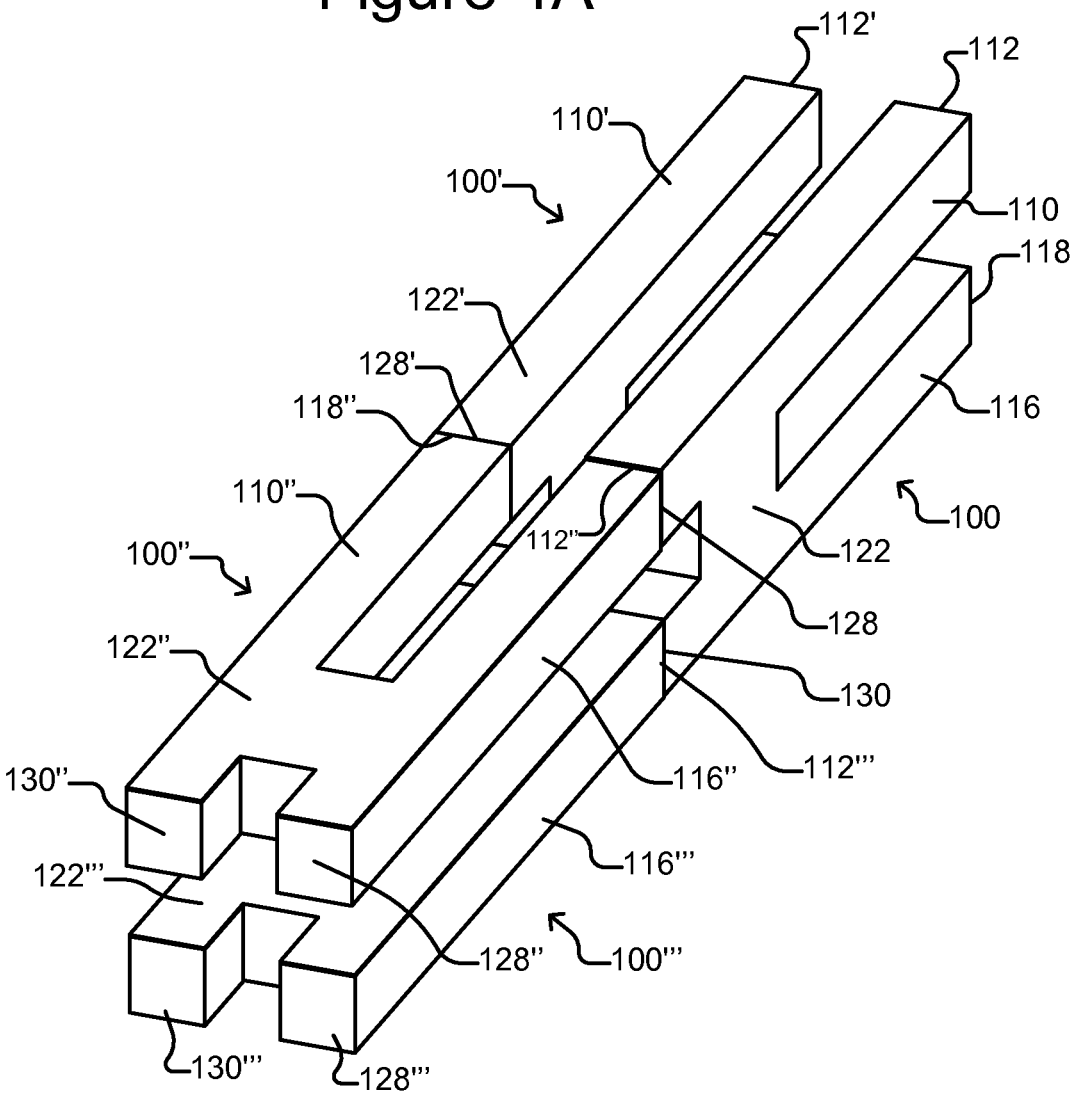
FIG. 4A shows the interconnected comparator waveguide subsystems of FIGS. 3A and 3B according to some embodiments of the invention.
Figure 4B:
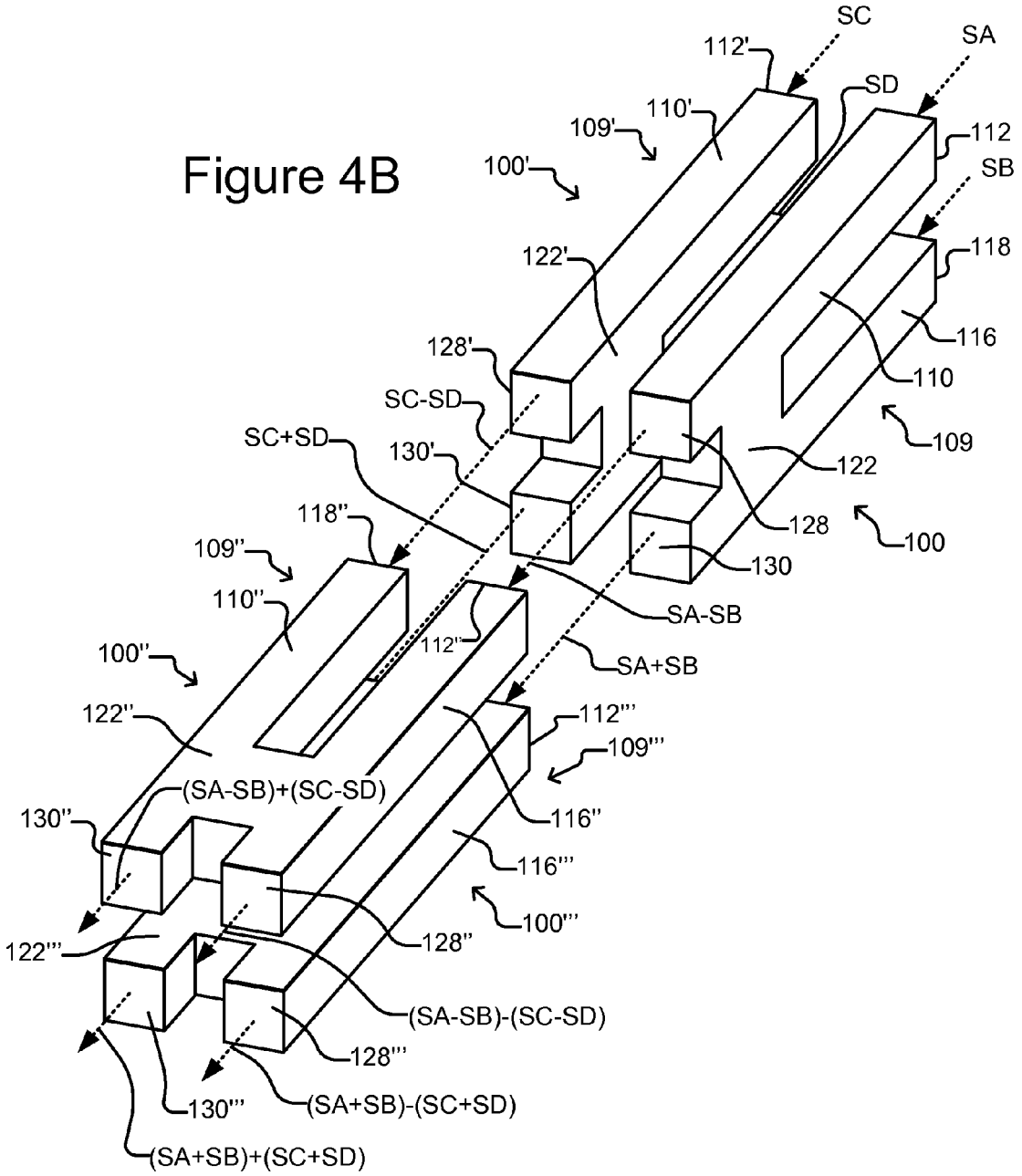
FIG. 4B shows a partially exploded view of FIG. 4A.
Figure 5:
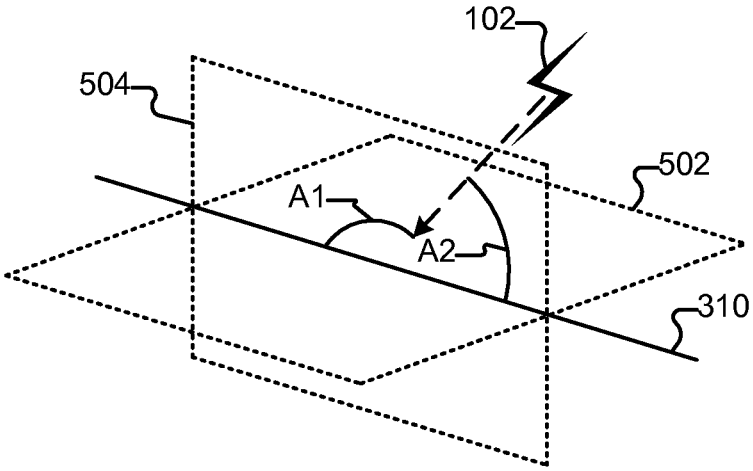
FIG. 5 shows an example of a mono-pulse RF signal.

As illustrated in FIGS. 4A and 4B, the first and second comparator waveguide subsystems 100 and 100' can be disposed in parallel, and the third and fourth comparator waveguide subsystems 100" and 100'" can be disposed in parallel with each other and in series with the first and second comparator waveguide subsystems 100 and 100'. As can be seen in FIG. 4B (which shows a partially exploded view of FIG. 4A), the RF signals SA, SB, SC, and SD can be provided generally in parallel to the first and second comparator waveguide subsystem 100 and 100', which can operate generally in parallel to produce combined signals SA−SB, SA+SB, SC−SD, and SC+SD at sum and difference ports 128, 130, 128', and 130'. Those signals—SA−SB, SA+SB, SC−SD, and SC+SD—produced by the first and second comparator waveguide subsystems 100 and 100' can then be provided generally in parallel to the input ports 112", 118", 112'", and 118'" of the third and fourth comparator waveguide subsystems 100" and 100'", which can operate generally in parallel to produce signals (SA−SB)−(SC−SD), (SA−SB)+(SC−SD), (SA+SB)−(SC+SD), (SA+SB)+(SC+SD) at sum and difference ports 128", 130", 128'", and 130'" as shown.

There are a number of possible applications for the use of multiple interconnected comparator waveguide subsystems such as the example illustrated in FIGS. 3A-4B. One such example is a dual-axis mono-pulse antenna system, which can be used, generally as discussed above, to track a moving target (not shown) from which the RF signal 102 is transmitted. As another example, such a dual-axis mono-pulse antenna system can be used in a mono-pulse radar system in which the RF signal 102 is a returning radar pulse.

FIG. 3A includes a block diagram of an antenna 301 with four antenna regions 302, 304, 306, and 308 disposed about a bore sight axis 310 such as can be part of a dual-axis mono-pulse antenna system. Similar to the discussion above with respect to FIG. 1, the antenna 301 and antenna regions 302, 304, 306, and 308 can be any kind of antenna system suitable for use with a dual-axis mono-pulse antenna system. For example, the antenna 301 can be a horn antenna (e.g., disposed at the focal point of a parabolic reflector antenna (not shown)), and the antenna regions 302, 304, 306, and 308 can be feed holes to the horn antenna. Alternatively, the antenna regions 302, 304, 306, and 308 can each be a distinct horn antenna. As yet other alternative, the antenna regions 302, 304, 306, and 308 can be other types of antennas.

An incoming RF signal 102 from a target (not shown) striking the antenna 301 can cause the antenna region 302 to generate the signal SA, the antenna region 304 to generate the signal SB, the antenna region 306 to generate the signal SC, and the antenna region 308 to generate the signal SD.

As discussed above, the comparator waveguide subsystems 100, 100', 100", and 100'" can then produce the combined signals (SA−SB)−(SC−SD), (SA−SB)+(SC−SD), (SA+SB)−(SC+SD), (SA+SB)+(SC+SD) at sum and difference ports 128", 130", 128'", and 130'" as shown in FIGS. 3A, 3B, and 4B and discussed above. The amplitudes and relative phases of the combined signals (SA−SB)−(SC−SD), (SA−SB)+(SC−SD), (SA+SB)−(SC+SD), (SA+SB)+(SC+SD) can be used to determine an angle A1 from the bore sight axis 310 of the incoming RF signal 102 in a first plane 502 through the bore sight axis 310 and an angle A2 from the bore sight axis 310 of the incoming RF signal 102 in a second plane 504, perpendicular to the first plane 502, through the bore sight axis 310. In some embodiments, the antenna 301 (including antenna regions 302, 304, 306, and 308) can be oriented such that the angle A1 corresponds to the azimuth angle and the angle A2 corresponds to the elevation angle of the target (not shown) from which the RF signal 102 is received.

Like FIG. 1, FIGS. 3A and 3B are block diagrams and thus show a simplified illustration. Other elements can be used with the system shown in FIGS. 3A and 3B. For example, there can be waveguide elements (not shown) between the antenna regions 302, 304, 306, and 308 and the input ports 112, 118, 112', and 118' of the first and second comparator components 109 and 109'. Examples of such waveguide elements include filters or polarizers (e.g., septum polarizers) disposed between the antenna regions 302, 304, 306, and 308 and the input ports 112, 118, 112', and 118'. Thus, for example, the signals SA, SB, SC, and SD can be filtered and/or polarized (e.g., circularly polarized) versions of the signals generated by the antenna regions 302, 304, 306, and 308 in response to the RF signal 102. Such filtering and/or polarizing can be configured such that the RF signals SA, SB, SC, and SD are in only the fundamental waveguide mode at input ports 112, 118, 112', and 118'. As another example, further elements, components, or equipment (not shown) can be included for guiding, modifying, processing, utilizing, and/or storing the combined signals (SA−SB)−(SC−SD), (SA−SB)+(SC−SD), (SA+SB)−(SC+SD), (SA+SB)+(SC+SD) from the sum and difference ports 128", 130", 128'", and 130'".

Figure 6A:
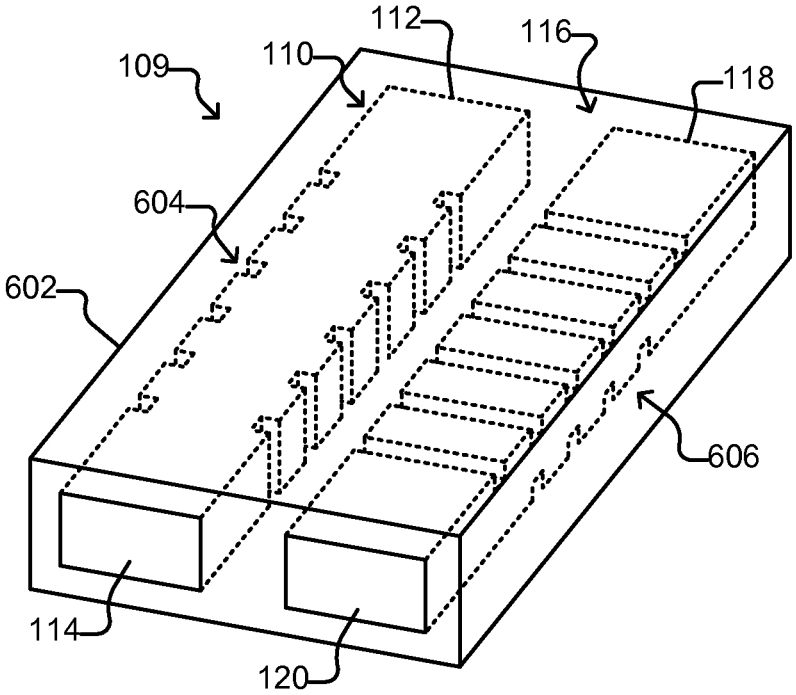
FIG. 6A illustrates an example of the phase shift component of the comparator waveguide subsystem of FIGS. 1, 3A, and 3B implemented in a waveguide structure according to some embodiments of the invention.
Figure 6B:
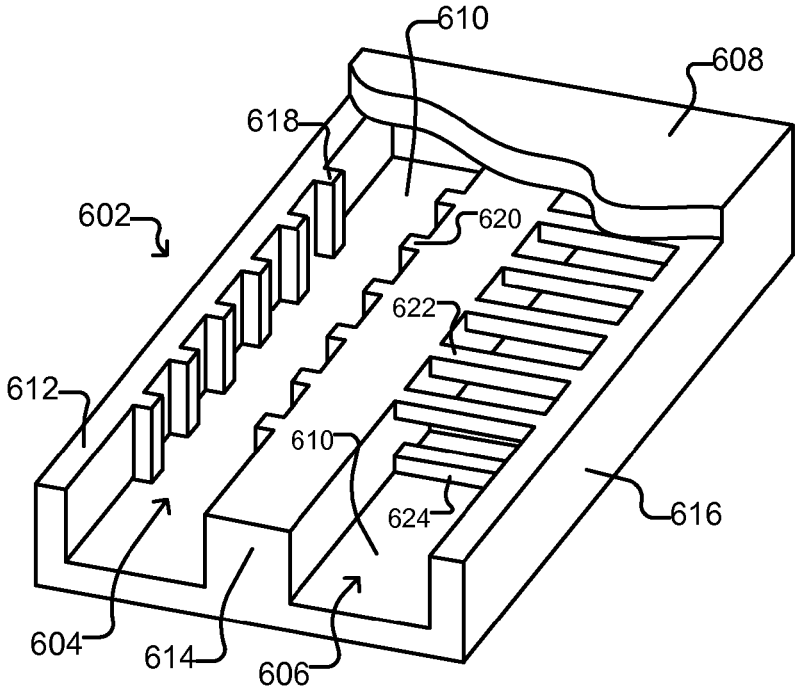
FIG. 6B shows a view of the phase shift component of FIG. 6A with most of the upper wall removed to provide a view inside the component.
Figure 7:
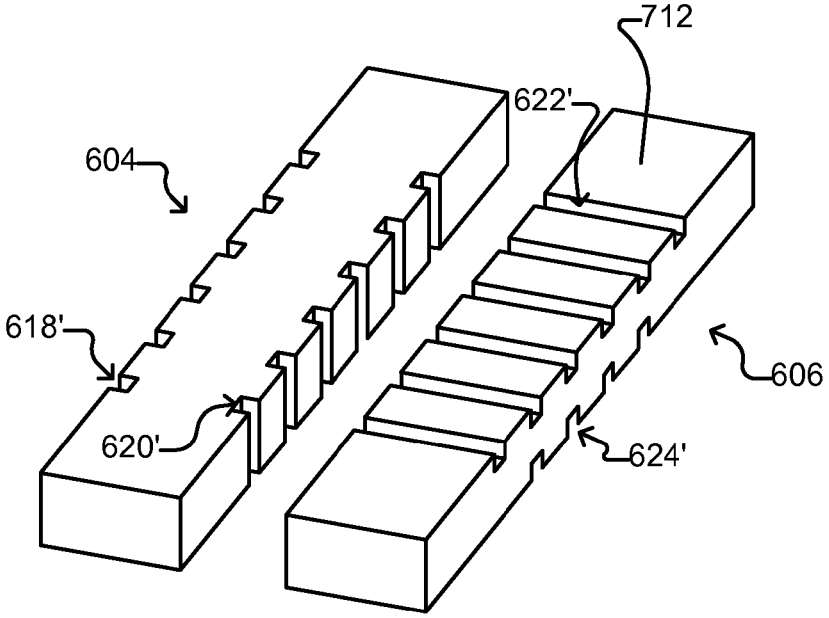
FIG. 7 shows a view of the cavities of the phase shift component of FIGS. 6A and 6B.
Figure 8A:
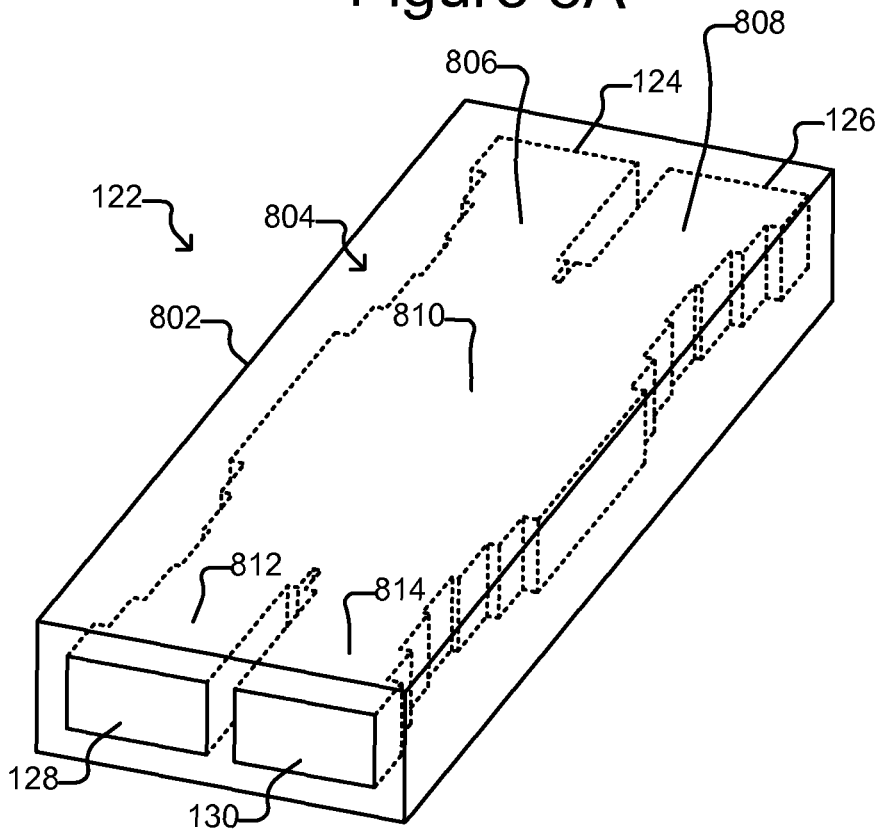
FIG. 8A illustrates an example of the comparator component of the comparator waveguide subsystem of FIGS. 1, 3A, and 3B implemented in a waveguide structure according to some embodiments of the invention.
Figure 8B:
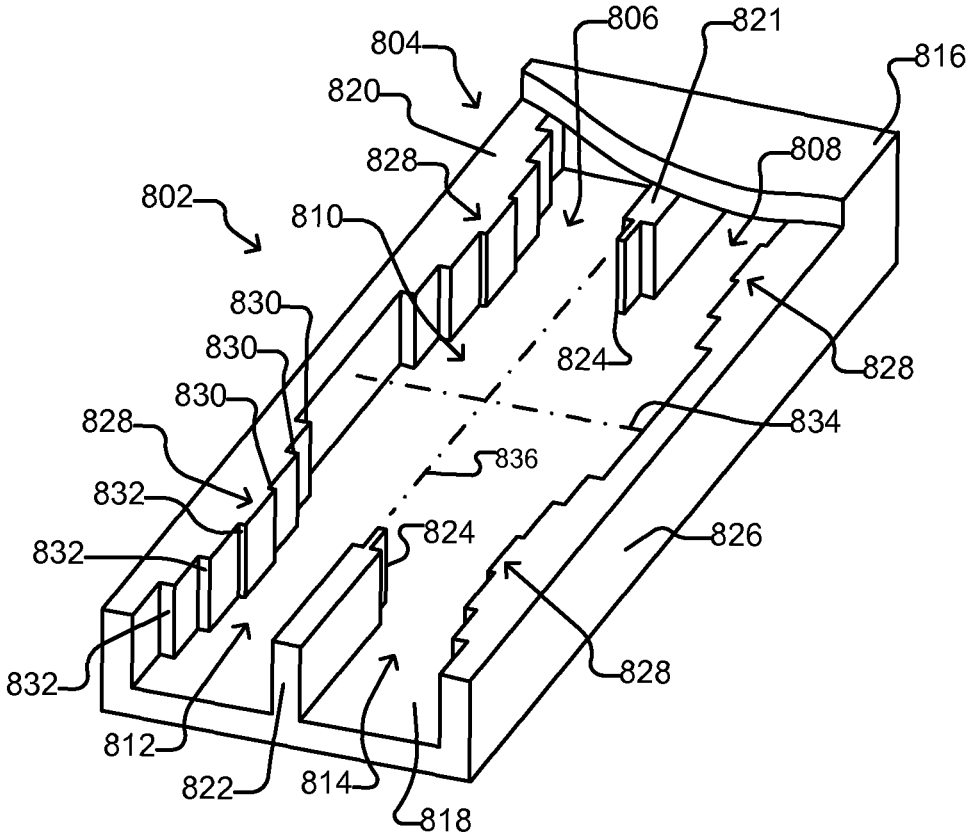
FIG. 8B shows a view of the comparator component of FIG. 8A with most of the upper wall removed to provide a view inside the component.
Figure 9:
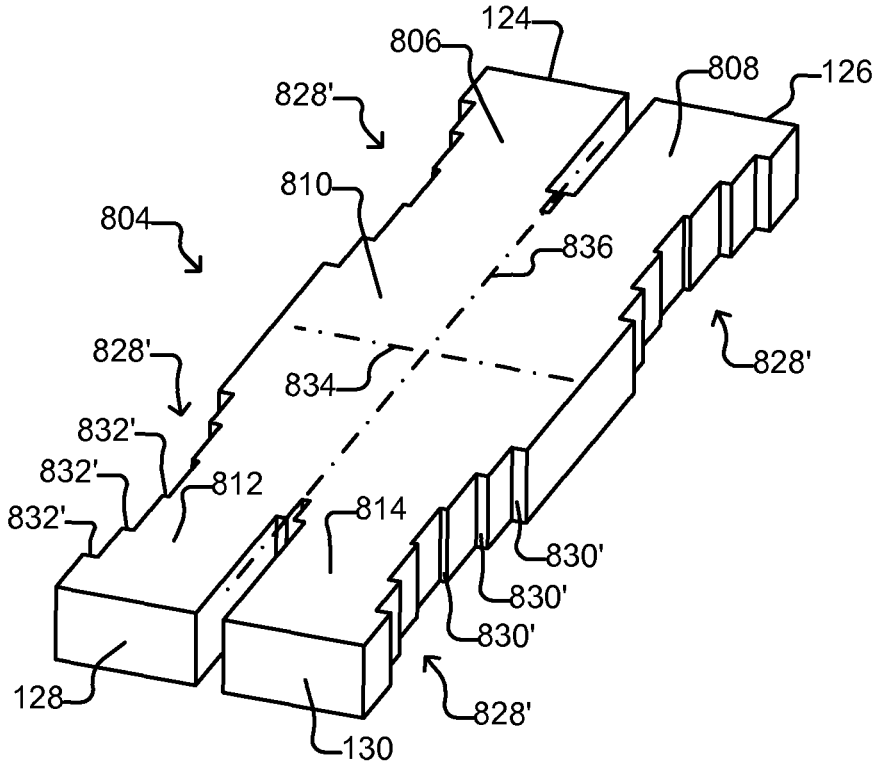
FIG. 9 shows a view of the cavity of the comparator component of FIGS. 8A and 8B.

As noted, the phase shift component 109 and the comparator component 122 of an RF comparator waveguide subsystem 100 (including 100', 100", and 100'") can be implemented as RF waveguide components. FIGS. 6A, 6B, and 7 illustrate an example of a configuration of the phase shift component 109, and FIGS. 8A, 8B, and 9 illustrate an example of a configuration of the comparator component 122. Thus, any of the phase shift components 109 illustrated in FIGS. 1-4B can be configured as shown in FIGS. 6A, 6B, and 7, and any of the comparator components 122 shown in FIGS. 1-4B can be configured as shown in FIGS. 8A, 8B, and 9.

FIGS. 6A, 6B, and 7 illustrate an example of the phase shift component 109 implemented in a waveguide structure 602 according to some embodiments of the invention. FIG. 6A shows a perspective view of the waveguide structure 602, and FIG. 6B shows the waveguide structure 602 without most of the upper wall 608, thus providing a view into the waveguide structure 602. FIG. 7 illustrates the cavities 604 and 606 in the waveguide structure 602 that correspond to the phase shift arms 110 and 116.

As shown in FIG. 6A, the phase shift component 109 can comprise cavities 604 and 606 in an RF waveguide structure 602. The cavity 604 can correspond to the phase shift arm 110, and the cavity 606 can correspond to the phase shift arm 116. The cavities 604 and 606 can be substantially the same length. That is, the length of the cavity 604 from the input port 112 to the output port 114 can be substantially the same length as the length of the cavity 606 from the input port 118 to the output port 120. The waveguide structure 602 can comprise an electrically conductive material such as a metal (e.g., aluminum), and the cavities 604 and 606 can be machined into or otherwise formed in the waveguide structure 602.

As shown in FIG. 6B, the cavity 604 can be enclosed by an upper wall 608, a lower wall 610, a first side wall 612, and a middle wall 614. First vertical ribs 618 can extend from the first side wall 612 into the cavity 604, and second vertical ribs 620 can extend from the middle wall 614 into the cavity 604. The cavity 604 can thus be as illustrated in FIG. 7: a generally rectangular block shape with rib indentations 618' that correspond to the first vertical ribs 618 and rib indentations 620' that correspond to the second vertical ribs 620.

As shown in FIG. 6B, the cavity 606 can be enclosed by the upper wall 608, the lower wall 610, the middle wall 614, and a second side wall 616. Upper horizontal ribs 622 can extend into the cavity 606 from the upper wall 608, and lower horizontal ribs 624 can extend into the cavity 606 from the lower wall 610. The cavity 606 can thus be as illustrated in FIG. 7: a generally rectangular block shape with rib indentations 622' that correspond to the upper horizontal ribs 622 and rib indentations 624' that correspond to the lower horizontal ribs 624.

The number, size, location, and pattern of the vertical ribs 618 and 620 and the horizontal ribs 622 and 624 can be configured to advance and/or delay the phases of RF signals passing through the cavities 604 and 606 so that, as discussed above, the RF signal passing through the cavity 604 is advanced by X degrees with respect to the RF signal passing through the cavity 606. As discussed above, X can be, in some embodiments, positive ninety degrees (+90°). For example, the number, size, location, and pattern of the first vertical ribs 618 and the second vertical ribs 620 can be selected to advance the phase of an RF signal passing through the cavity 604 by positive forty-five degrees (+45°), and the number, size, location, and pattern of the upper ribs 622 and lower ribs 624 can be selected to delay the phase of an RF signal passing through the cavity 606 by forty-five degrees (−45°).

In some embodiments, the size and shape of the first vertical ribs 618, second vertical ribs 620, upper horizontal ribs 622, and lower horizontal ribs 624 can be generally the same. In some embodiments, there can be an equal number of first vertical ribs 618 and second vertical ribs 620 but an unequal number of upper horizontal ribs 622 and lower horizontal ribs 624. For example, there can be more upper horizontal ribs 622 than lower horizontal ribs 624 or vice versa. In some embodiments, the pattern of the first vertical ribs 618 can be generally the same as and symmetrically disposed with respect to the pattern of the second vertical ribs 620, but the pattern of the upper horizontal ribs 622 can be different than the pattern of the lower horizontal ribs 624. As illustrated in FIGS. 6A, 6B, and 7, the vertical ribs 618 and 620 can be oriented generally perpendicular to the horizontal ribs 622 and 624.

FIGS. 8A, 8B, and 9 illustrate an example of the comparator component 122 implemented in a waveguide structure 802 according to some embodiments of the invention. FIG. 8A shows a perspective view of the waveguide structure 802, and FIG. 8B shows the waveguide structure 802 without most of the upper wall 816, thus providing a view into the waveguide structure 802. FIG. 9 illustrates the cavity 804 in the waveguide structure 802.

As shown in FIG. 8A, the comparator component 122 can comprise a cavity 804 in an RF waveguide structure 802. The waveguide structure 802 can be an electrically conductive material such as a metal (e.g., aluminum), and the cavity 804 can be machined into or otherwise formed in the waveguide structure 802.

As shown, the cavity 804 can comprise a first input passage 806, a second input passage 808, a common space 810, a first output passage 812, and a second output passage 814. As best seen in FIG. 8B, the cavity 804 can be enclosed by an upper wall 816, a lower wall 818, a first side wall 820, and a second side wall 826. A first divider wall 821 can divide the first input passage 806 from the second input passage 808, and a second divider wall 822 can divide the first output passage 812 from the second output passage 814.

As best seen in FIG. 8B, the first sidewall 820 can include a plurality of stepped regions 828 each comprising inward steps 830 and outward steps 832. The steps 830 and 832 can be tuning steps. Although the first sidewall 820 is illustrated as having two stepped regions 828, the first sidewall 820 can have fewer or more stepped regions 828. Likewise, although each stepped region 828 is illustrated as having three inward steps 830 and three outward steps 832, a region 828 can have fewer or more inward steps 830 and/or outward steps 832. The stepped regions 828 can provide filtering functions that allow for processing of broadband RF signals.

As also shown in FIG. 8B, each divider wall 821 and 822 can include a nub 824 that extends into the common space 810. The divider walls 821 and 822, including nub 824, can aid in the function of splitting RF signals from the first input passage 806 and the second input passage 808.

The shape and size of the cavity 804 can be configured to perform the function of the comparator component 122 as discussed above. That is, the cavity 804 can be shaped and sized to split an RF signal (e.g., signal SA') in the first input passage 806 into a first signal part (e.g., signal SA") that passes to the first output passage 812 without a relative change in phase and a second signal part (e.g., signal SA"') that passes to the second output passage 814 with a relative phase delay of Y degrees as generally discussed above. The cavity 804 can also be shaped and sized to split an RF signal (e.g., signal SB') in the second input passage 808 into a first signal part (e.g., signal SB") that passes to the second output passage 814 without a relative change in phase and a second signal part (e.g., signal SB"') that passes to the first output passage 812 with a relative phase delay of Y degrees as generally discussed above. As discussed above, Y can be, in some embodiments, a relative phase delay of ninety degrees (−90°). For example, the cavity 804 can be shaped and sized to split the RF signal in the first input passage 806 into signal parts of approximately equal power and cause the first signal part to pass to the first output passage 812 and the second signal part to pass to the second output passage 814 with a substantially ninety degree relative delay in phase. The cavity 804 can also be shaped and sized to split the RF signal in the second input passage 808 into signal parts of approximately equal power and cause the first signal part to pass to the second output passage 814 and the second signal part to pass to the first output passage 812 with a substantially ninety degree relative delay in phase.

In some embodiments, the shape of the cavity 804 can be symmetrical about two perpendicular axes 834 and 836 that cross in the common space 810. For example, the shape of the cavity 804 can be symmetrical about two perpendicular axes 834 and 836 that cross at the center of the common space 810, which can be the center of the cavity 804. As shown, the axes 834 and 836 can be parallel to the upper wall 816 and the lower wall 818. Thus, the first side wall 820 can be a mirror image (e.g., about the axis 836) of the second side wall 826.

Similarly, the first divider wall 821 can be a mirror image (e.g., about the axis 834) of the second diver wall 822. Also, the length of cavity 804 from the input port 124 to the difference port 128 can be substantially the same length as the length of the cavity 804 from the input port 126 to the sum port 130.

Although specific embodiments and applications of the invention have been described in this specification, these embodiments and applications are exemplary only, and many variations are possible.

We claim:

1. A waveguide apparatus comprising:

a first comparator waveguide subsystem comprising an input port A, an input port B, a difference port A−B, and a sum port A+B, wherein said first comparator waveguide subsystem is structured to produce at said difference port A−B a difference signal A−B that is a subtraction of a signal B at said input port B from a signal A at said input port A and produce at said sum port A+B a sum signal A+B that is a sum of said signal A and said signal B, wherein said first comparator waveguide subsystem comprises:

a first phase shifter comprising a hollow cavity A from said input port A to an intermediate port A and a hollow cavity B from said input port B to an intermediate port B, said cavity B being substantially parallel to said cavity A, and a first comparator comprising:

a hollow input passage A from said intermediate port A to a hollow common space AB, a hollow input passage B from said intermediate port B to said common space AB, said input passage B being substantially parallel to said input passage A, a hollow output passage A from said common space AB to said difference port A−B, said output passage A being substantially axially aligned with said input passage A, and a hollow output passage B from said common space AB to said sum port A+B, said output passage B being substantially axially aligned with said input passage B and parallel to said output passage A;

a second comparator waveguide subsystem comprising an input port C, an input port D, a difference port C−D, and a sum port C+D, wherein said second comparator waveguide subsystem is structured to produce at said difference port C−D a difference signal C−D that is a subtraction of a signal D at said input port D from a signal C at said input port C and produce at said sum port C+D a sum signal C+D that is a sum of said signal C and said signal D, wherein said second comparator waveguide subsystem comprises:

a second phase shifter comprising a hollow cavity C from said input port C to an intermediate port C and a hollow cavity D from said input port D to an intermediate port D, said cavity D being substantially parallel to said cavity C, and a second comparator comprising:

a hollow input passage C from said intermediate port C to a common space CD, a hollow input passage D from said intermediate port D to said common space CD, said input passage D being substantially parallel to said input passage C, a hollow output passage C from said common space CD to said difference port C−D, said output passage C being substantially axially aligned with said input passage D, and a hollow output passage D from said common space CD to said sum port C+D, said output passage D being substantially axially aligned with said input passage D and parallel to said output passage C;

a third comparator waveguide subsystem comprising an input port A−B connected to said difference port A−B of said first comparator, an input port C−D connected to said difference port C−D of said second comparator, a difference port (A−B)−(C−D), and a sum port (A−B)+(C−D), wherein said third comparator waveguide subsystem is structured to produce at said difference port (A−B)−(C−D) a difference signal (A−B)−(C−D) that is a subtraction of said difference signal C−D from said difference signal A−B and produce at said sum port (A−B)+(C−D) a sum signal (A−B)+(C−D) that is a sum of said difference signal A−B and said difference signal C−D, wherein said third comparator waveguide subsystem comprises:

a third phase shifter comprising a hollow cavity A−B from said input port A−B to an intermediate port A−B and a hollow cavity C−D from said input port C−D to an intermediate port C−D, said cavity C−D being substantially parallel to said cavity A−B, and a third comparator comprising:

a hollow input passage A−B from said intermediate port A−B to a common space (A−B)(C−D), a hollow input passage C−D from said intermediate port C−D to said common space (A−B)(C−D), said input passage C−D being substantially parallel to said input passage A−B, a hollow output passage A−B from said common space (A−B)(C−D) to said difference port (A−B)−(C−D), said output passage A−B being substantially axially aligned with said input passage A−B, and a hollow output passage C−D from said common space (A−B)(C−D) to said sum port (A−B)+(C−D), said output passage C−D being substantially axially aligned with said input passage C−D and parallel to said output passage A−B; and a fourth comparator waveguide subsystem comprising an input port A+B connected to said sum port A+B of said first comparator, an input port C+D connected to said sum port C+D of said second comparator, a sum port (A+B)+(C+D), and a difference port (A+B)−(C+D), wherein said fourth comparator waveguide subsystem is structured to produce at said difference port (A+B)−(C+D) a difference signal (A+B)−(C+D) that is a subtraction of said sum signal C+D from said sum signal A+B and produce at said sum port (A+B)+(C+D) a sum signal (A+B)+(C+D) that is a sum of said sum signal A+B and said sum signal C+D, wherein said fourth comparator waveguide subsystem comprises:

a fourth phase shifter comprising a hollow cavity A+B from said input port A+B to an intermediate port A+B and a hollow cavity C+D from said input port C+D to an intermediate port C+D, said cavity C+D being substantially parallel to said cavity A+B, and a fourth comparator comprising:

a hollow input passage A+B from said intermediate port A+B to a common space (A+B)(C+D), a hollow input passage C+D from said intermediate port C+D to said common space (A+B)(C+D), said input passage C+D being substantially parallel to said input passage A+B, a hollow output passage A+B from said common space (A+B(C+D) to said difference port (A+B)−

(C+D), said output passage A+B being substantially axially aligned with said input passage A+B, and a hollow output passage C+D from said common space (A+B)(C+D) to said sum port (A+B)+(C+D), said output passage C+D being substantially axially aligned with said input passage C+D and parallel to said output passage A+B.

2. The apparatus of claim 1, wherein:

said second comparator waveguide subsystem is disposed in parallel to said first comparator waveguide subsystem, and said fourth comparator waveguide subsystem is disposed in parallel to said third comparator waveguide subsystem.

3. The apparatus of claim 2, wherein:

said third comparator waveguide subsystem is disposed in series with said first comparator waveguide subsystem and said second comparator waveguide subsystem; and said fourth comparator waveguide subsystem is disposed in series with said first comparator waveguide subsystem and said second comparator waveguide subsystem.

4. The apparatus of claim 1 further comprising a horn antenna, wherein:

a first feed hole of said horn antenna is connected to said input port A of said first comparator waveguide subsystem, a second feed hole of said horn antenna is connected to said input port B of said first comparator waveguide subsystem, a third feed hole of said horn antenna is connected to said input port C of said second comparator waveguide subsystem, and a fourth feed hole of said horn antenna is connected to said input port D of said second comparator waveguide subsystem.

5. The apparatus of claim 4, wherein said signal A, said signal B, said signal C, and said signal D correspond to a radio frequency signal received at said horn antenna.

6. The apparatus of claim 1, wherein said first comparator waveguide subsystem is implemented entirely in a straight section of a waveguide structure.

7. The apparatus of claim 1, wherein a length of said first comparator waveguide subsystem from said input port A to said difference port A−B is substantially equal to a length of said first comparator waveguide subsystem from said input port B to said sum port A+B.

8. The apparatus of claim 1, wherein:

said cavity A, said input passage A, said output passage A, said cavity A−B, said input passage A−B, and said output passage A−B are substantially axially aligned one with another, said cavity C, said input passage C, said output passage C, said cavity C−D, said input passage C−D, and said output passage C−D are substantially axially aligned one with another, said cavity B, said input passage B, said output passage B, said cavity A+B, said input passage A+B, and said output passage A+B are substantially axially aligned one with another, and said cavity D, said input passage D, said output passage D, said cavity C+D, said input passage C+D, and said output passage C+D are substantially axially aligned one with another.

9. The apparatus of claim 8, wherein each of the following is bounded by opposing electrically conductive side walls and opposing electrically conductive top and bottom walls:

said cavities A, B, C, D, A−B, C−D, A+B, and C+D;

said input passages A, B, C, D, A−B, C−D, A+B, and C+D;

said common spaces AB, CD, (A−B)(C−D), and (A+B)(C+D); and said output passages A, B, C, D, A−B, C−D, A+B, and C+D.

10. The apparatus of claim 9, wherein each of the following pairs of input passages is separated by a dividing wall:

said input passages A and B, said input passages C and D, said input passages A−B and C−D, and said input passages A+B and C+D.

11. The apparatus of claim 10, wherein each of the following pairs of output passages is separated by a dividing wall:

said output passages A and B, said output passages C and D, said output passages A−B and C−D, and said output passages A+B and C+D.

12. The apparatus of claim 8, wherein each of the following cavities comprises ribs along a length thereof: said cavities A, B, C, D, A−B, C−D, A+B, and C+D.

13. The apparatus of claim 12, wherein:

at least one of said input passage A, said input passage B, said common space AB, said output passage A, and said output passage B comprise tuning steps along at least one sidewall, top wall, or bottom wall thereof, at least one of said input passage C, said input passage D, said common space CD, said output passage C and said output passage D comprise tuning steps along at least one sidewall, top wall, or bottom wall thereof, at least one of said input passage A−B, said input passage C−D, said common space (A−B)(C−D), said output passage A−B, and said output passage C−D comprise tuning steps along at least one sidewall, top wall, or bottom wall thereof, and at least one of said input passage A+B, said input passage C+D, said common space (A+B)(C+D), said output passage A+B, and said output passage C+D comprise tuning steps along at least one sidewall, top wall, or bottom wall thereof.

14. A process of combining radio frequency signals into sum and difference combinations, said process comprising: providing four parallel input RF signals A, B, C, and D to first and second parallel comparator waveguide subsystems in substantially only a fundamental waveguide mode; generating in said first and second parallel comparator waveguide subsystems from said four parallel input RF signals A, B, C, and D an RF difference signal A−B, an RF difference signal C−D, an RF sum signal A+B, and an RF sum signal C+D, wherein said difference signal A−B is a subtraction of said signal B from said signal A, said difference signal C−D is a subtraction of said signal D from said signal C, said sum signal A+B is an addition of said signal A and said signal B, and said sum signal C+D is an addition of said signal C and said signal D; and generating in third and fourth parallel comparator waveguide subsystems from said difference signal A−B, said difference signal C−D, said sum signal A+B, and said sum signal C+D an RF difference signal (A−B)−(C−D), an RF difference signal (A+B)−(C+D), an RF sum signal (A−B)+(C−D), and an RF sum signal (A+B)+(C+D), wherein said difference signal (A−B)−(C−D) is a subtraction of said signal C−D from said signal A−B, said difference signal (A+B)−(C+D) is a subtraction of said signal C+D from said signal A+B, said sum signal (A−B)+(C−D) is an addition of said signal A−B and said signal C−D, and said sum signal (A+B)+(C+D) is an addition of said signal A+B and said signal C+D, wherein said first comparator waveguide subsystem comprising an input port A, an input port B, a difference port A−B, and a sum port A+B, wherein said first comparator waveguide subsystem is structured to produce at difference port A−B a difference signal A−B that is a subtraction of a signal B at input port B from a signal A at input port A and produce at sum port A+B a sum signal A+B that is a sum of said signal A and said signal B, wherein said first comparator waveguide subsystem comprises: a first phase shifter comprising a cavity A from said input port A to an intermediate port A and a cavity B from said input port B to an intermediate port B, said cavity B being substantially parallel to said cavity A and a first comparator comprising: an input passage A from said intermediate port A to a common space AB, an input passage B from said intermediate port B to said common space AB, said input passage B being substantially parallel to said input passage A, an output passage A from said common space AB to said difference port A−B, said output passage A being substantially axially aligned with said input passage A, and an output passage B from said common space AB to said sum port A+B, said output passage B being substantially axially aligned with said input passage B and parallel to said output passage A; said second comparator waveguide subsystem comprising an input port C, an input port D, a difference port C−D, and a sum port C+D, wherein said second comparator waveguide subsystem is structured to produce at said difference port C−D a difference signal C−D that is a subtraction of a signal D at input port D from a signal C at input port C and produce at said sum port C+D a sum signal C+D that is a sum of said signal C and said signal D, wherein said second comparator waveguide subsystem comprises: a second phase shifter comprising a cavity C from said input port C to an intermediate port C and a cavity D from said input port D to an intermediate port D, said cavity D being substantially parallel to said cavity C and a second comparator comprising: an input passage C from said intermediate port C to a common space CD, an input passage D from said intermediate port D to said common space CD, said input passage D being substantially parallel to said input passage C, an output passage C from said common space CD to said difference port C−D, said output passage C being substantially axially aligned with said input passage C, and an output passage D from said common space CD to said sum port C+D, said output passage D being substantially axially aligned with said input passage D and parallel to said output passage C; said third comparator waveguide subsystem comprising an input port A−B connected to said difference port A−B of said first comparator, an input port C−D connected to said difference port C−D of said second comparator, a difference port (A−B)−(C−D), and a sum port (A−B)+(C−D), wherein said third comparator waveguide subsystem is structured to produce at said difference port (A−B)−(C−D) a difference signal (A−B)−(C−D) that is a subtraction of said difference signal C−D from said difference signal A−B and produce at said sum port (A−B)+(C−D) a sum signal (A−B)+(C−D) that is a sum of said difference signal A−B and said difference signal C−D, wherein said third comparator waveguide subsystem comprises: a third phase shifter comprising a cavity A−B from said input port A−B to an intermediate port A−B and a cavity C−D from said input port C−D to an intermediate port C−D, said cavity C−D being substantially parallel to said cavity A−B and a third comparator comprising: an input passage A−B from said intermediate port A−B to a common space (A−B)(C−D), an input passage C−D from said intermediate port C−D to said common space (A−B)(C−D), said input passage C−D being substantially parallel to said input passage A−B, an output passage A−B from said common space (A−B)(C−D) to said difference port (A−B)−(C−D), said output passage A−B being substantially axially aligned with said input passage A−B, and an output passage C−D from said common space (A−B)(C−D) to said sum port (A−B)+(C−D), said output passage C−D being substantially axially aligned with said input passage C−D and parallel to said output passage A−B; and said fourth comparator waveguide subsystem comprising an input port A+B connected to said sum port A+B of said first comparator, an input port C+D connected to said sum port C+D of said second comparator, a sum port (A+B)+(C+D), and a difference port (A+B)−(C+D), wherein said fourth comparator waveguide subsystem is structured to produce at said difference port (A+B)−(C+D) a difference signal (A+B)−(C+D) that is a subtraction of said sum signal C+D from said sum signal A+B and produce at said sum port (A+B)+(C+D) a sum signal (A+B)+(C+D) that is a sum of said sum signal A+B and said sum signal C+D, wherein said fourth comparator waveguide subsystem comprises: a fourth phase shifter comprising a cavity A+B from said input port A+B to an intermediate port A+B and a cavity C+D from said input port C+D to an intermediate port C+D, said cavity C+D being substantially parallel to said cavity A+B and a fourth comparator comprising: an input passage A+B from said intermediate port A+B to a common space (A+B)(C+D), an input passage C+D from said intermediate port C+D to said common space (A+B)(C+D), said input passage C+D being substantially parallel to said input passage A+B, an output passage A+B from said common space (A+B)(C+D) to said difference port (A+B)−(C+D), said output passage A+B being substantially axially aligned with said input passage A+B, and an output passage C+D from said common space (A+B)(C+D) to said sum port (A+B)+(C+D), said output passage C+D being substantially axially aligned with said input passage C+D and parallel to said output passage A+B.

15. The process of claim 14 further comprising:

receiving an RF signal at a horn antenna, providing said RF signal through a first feed hole of said horn antenna as said input RF signal A to said first comparator waveguide subsystem or said second comparator waveguide subsystem, providing said RF signal through a second feed hole of said horn antenna as said input RF signal B to said first comparator waveguide subsystem or said second comparator waveguide subsystem, providing said RF signal through a third feed hole of said horn antenna as said input RF signal C to said first comparator waveguide subsystem or said second comparator waveguide subsystem, and providing said RF signal through a fourth feed hole of said horn antenna as said input RF signal D to said first comparator waveguide subsystem or said second comparator waveguide subsystem.

16. The process of claim 14 further comprising:

outputting from said first and second parallel comparator waveguide subsystems said RF difference signal A−B in substantially only a fundamental waveguide mode, and outputting from said first and second parallel comparator waveguide subsystems said RF sum signal A+B in substantially only a fundamental waveguide mode.

17. The process of claim 16 further comprising: outputting from said first and second parallel comparator waveguide subsystems said RF difference signal C−D in substantially only a fundamental waveguide mode, and outputting from said first and second parallel comparator waveguide subsystems said RF sum signal C+D in substantially only a fundamental waveguide mode.

18. The process of claim 14, wherein: said cavity A, said input passage A, said output passage A, said cavity A−B, said input passage A−B, and said output passage A−B are substantially axially aligned one with another, said cavity C, said input passage C, said output passage C, said cavity C−D, said input passage C−D, and said output passage C−D are substantially axially aligned one with another, said cavity B, said input passage B, said output passage B, said cavity A+B, said input passage A+B, and said output passage A+B are substantially axially aligned one with another, and said cavity D, said input passage D, said output passage D, said cavity C+D, said input passage C+D, and said output passage C+D are substantially axially aligned one with another.

* * * * *